United States Patent [19]

Bischofberger et al.

[11] Patent Number: 5,060,346

[45] Date of Patent: Oct. 29, 1991

[54] COMBING MACHINE WITH SUCTION TRANSFER OF COMBED FIBERS

[75] Inventors: Jurg Bischofberger, Elsau-Raterschen; Andreas Jörg, Neftenbach; Giancarlo Mondini; Peter Oehy, both of Winterthur, all of Switzerland

[73] Assignee: Rieter Machine Works, Ltd., Wintherthur, Switzerland

[21] Appl. No.: 591,742

[22] Filed: Oct. 2, 1990

Related U.S. Application Data

[63] Continuation-in-part of Ser. No. 438,177, Nov. 20, 1989.

[30] Foreign Application Priority Data

Nov. 23, 1988 [CH] Switzerland ..... 04356/88

[51] Int. Cl.[5] ..... D01G 19/28

[52] U.S. Cl. ..... 19/225

[58] Field of Search ..... 19/221-235

[56] References Cited

U.S. PATENT DOCUMENTS

| | | | |
|---|---|---|---|
| 1,605,135 | 11/1926 | Nasmith . | |
| 1,714,017 | 5/1929 | Gegauff | 19/227 |
| 1,739,159 | 5/1929 | Gegauff | 19/227 |
| 2,663,053 | 12/1953 | Schleifer | 19/227 |
| 4,947,521 | 8/1990 | Joerg et al. | 19/235 |

FOREIGN PATENT DOCUMENTS

| | | | |
|---|---|---|---|
| 0664202 | 9/1965 | Belgium . | |
| 2139305 | 2/1975 | Fed. Rep. of Germany . | |
| 2264899 | 3/1974 | France | 19/23 |
| 0475379 | 8/1969 | Switzerland . | |
| 0011392 | of 1885 | United Kingdom | 19/229 |
| 0334194 | 8/1930 | United Kingdom | 19/229 |

*Primary Examiner*—Werner H. Schroeder
*Assistant Examiner*—John J. Calvert
*Attorney, Agent, or Firm*—Sandler, Greenblum & Bernstein

[57] ABSTRACT

The combing machine comprises a continuously rotatable circular-comb cylinder carrying a circular-comb segment and detaching segment. The detaching segment cooperates with a detaching pressure roll. The combing machine also contains a nipper unit comprising a lower nipper which is stationary relative to the axis of the continuously rotatable circular-comb cylinder, and an upper nipper which is movable relative to the lower nipper. The fibers detached by the detaching segment together with the detaching pressure roll are sucked as fiber clusters into a suction shaft or tube, or can be united to form a sliver at a rotatable screening or sieve drum. The suction shaft includes a flexible membrane to close the shaft. The combining machine is of simple construction and economical to manufacture and renders possible a high operating speed and, therefore, a higher output, particularly in the absence of a top comb between the lower nipper and the detaching pressure roll.

18 Claims, 5 Drawing Sheets

COMBING MACHINE WITH SUCTION TRANSFER OF COMBED FIBERS

CROSS-REFERENCE TO RELATED PATENT APPLICATION

This application is a continuation-in-part of the commonly assigned, copending United States application Ser. No. 07/438,177, filed Nov. 20, 1989, entitled "COMBING MACHINE" and is related to the commonly assigned, copending United States Patent Application Ser. No. 07/409,365, filed Sept. 19, 1989, entitled "COMBING MACHINE" the disclosures of which are incorporated herein by reference.

BACKGROUND OF THE INVENTION

The present invention relates to a new and improved construction of combing machine comprising a continuously rotatable cylinder or roll which carries at least one circular-comb segment and at least one detaching segment which cooperates with a detaching pressure roll or roller. The combing machine also contains a nipper unit comprising a lower or bottom nipper which is stationary relative to the axis of the continuously rotatable cylinder or roll, and an upper or top nipper which is movable relative to the lower or bottom nipper.

A combing machine having the aforementioned components and constructional details was proposed by Heilman as early as 1945.

SUMMARY OF THE INVENTION

Therefore, with the foregoing in mind it is a primary object of the present invention to provide a new and improved construction of a combing machine of the aforementioned type which is simple in construction and design and can be economically manufactured.

Another and more specific object of the present invention aims at providing a new and improved construction of a combing machine by means of which substantially higher production rate, i.e., fiber quantity per unit of time, is rendered possible in comparison with the productivity of prior art combing machines.

Yet a further significant object of the present invention aims at providing a new and improved construction of comber or combing machine which reduces cost of fabrication, increases productivity in terms of combed-out fibers per unit of time and yet affords highly reliable operation thereof, without being subject to breakdown or malfunction.

Now in order to implement these and still further objects of the present invention, which will become more readily apparent as the description proceeds, the combing machine of the present invention is manifested, among other things, by the features that suction means are provided for intaking or conveying by suction the fibers detached by the detaching segment and the detaching pressure roll or roller.

The suction means render possible dispensing with the separate or individual detaching roll or roller provided in hitherto known combing machines, and with the conventional detaching pressure roll or roller which cooperates with the separate or individual detaching roll or roller and is rotated in pilgrim-step manner.

In its simplest form, the suction means can comprise a suction shaft or tube having an intake port or opening adjacent to the detaching pressure roll or roller which cooperates with the at least one detaching segment.

However, with a suction shaft or tube there are obtained individual fiber clusters and not a combed sliver. In other words, the combing machine practically operates as a staple sorting or grading machine.

On the other hand, the fiber suction means can constitute a screening or sieve drum, the inner chamber or space of the latter being connectable to a source of negative pressure or underpressure or vacuum. Such screening or sieve drum renders possible the production of a combed-out sliver.

A further functional constructional simplification and a considerable increase in productivity or output are rendered possible if the top comb used in known combers or combing machines is dispensed with, i.e. if there is provided a free space without additional combing elements between the lower or bottom nipper and the detaching pressure roll or roller when the nipper unit is in its open or front end position. Dispensing with the use of a top comb would mean having to put up with a reduction or decrease in combing quality. Such decrease in combing quality can be held within limits if the nipper unit is provided with an additional nipper which is movable relative to the lower or bottom nipper, in order to clamp thereat a lap fed thereto during the detachment of fibers from such lap. Instead of providing such an additional nipper, the nipper unit can also advantageously comprise a rotatable lap-pressing cylinder or roll for pressing against the lower or bottom nipper a lap to be combed.

Another object of the invention is to provide a closing element for the suction tube or shaft. The closing element may be a rubber membrane that is pushed into and closes the tube or shaft.

BRIEF DESCRIPTION OF THE DRAWINGS

The above and additional objects, characteristics, and advantages of the present invention will become apparent in the following detailed description of preferred embodiments, with reference to the accompanying drawings which are presented as non-limiting examples, in which.

DETAILED DESCRIPTION OF PREFERRED EMBODIMENTS

Figure 1:
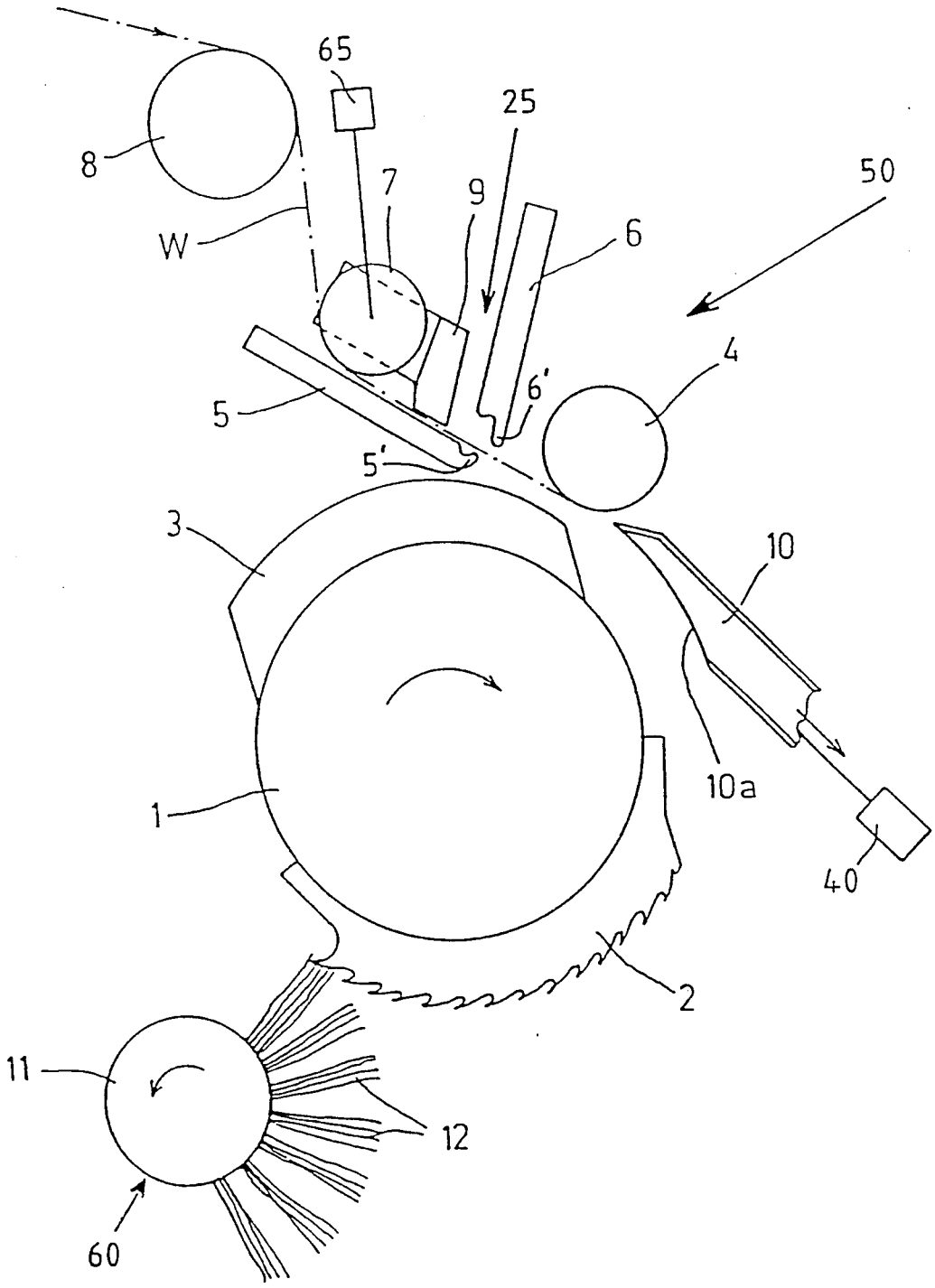
FIG. 1 schematically shows in a substantially vertical sectional side view the main or essential parts of components of a combing machine constructed according to the invention.

Describing now the drawings, it is to be understood that to simplify the showing thereof, only enough of the combing machine has been illustrated therein as is needed to enable one skilled in the art to readily understand the underlying principles and concepts of the present invention. Turning attention now specifically to FIG. 1 of the drawings, a combing machine 50 schematically shown therein by way of example and not limitation will be seen to comprise a continuously rotatable circular-comb cylinder or roll 1 provided with a circular-comb segment 2 and a detaching segment 3, the latter cooperating with a detaching pressure roll or roller 4. The continuously rotatable circular-comb cylinder or roll 1 could be provided with a number of circular-comb segments 2 as well as a number of detaching segments 3.

The combing machine 50 also comprises a nipper unit 25 having a lower or bottom nipper 5 which is stationary relative to the axis of the rotatable circular-comb cylinder or roll 1, and an upper or top nipper 6. The latter is movable relative to the lower or bottom nipper 5, in order to clamp between a front edge 5' of the lower or bottom nipper 5 and a bottom edge 6' of the upper or top nipper 6 a fiber tuft which is then combed out by the circular-comb segment 2 passing beneath the lower or bottom nipper 5.

An intermittently rotatable feed cylinder or roll 7 is suitably mounted in lateral or side arms of the lower or bottom nipper 5 which are not particularly illustrated in the drawings. From a delivery or supply roll 8 there is fed to the intermittently rotatable feed cylinder or roll 7 a lap W which is to be combed. Furthermore, there is arranged in the nipper unit 25 a suitable lap-pressing element or member which serves to press the lap W against the lower or bottom nipper 5 at a location between the intermittent rotatable feed cylinder or roll 7 and the front edge 5' of the lower or bottom nipper 5.

In the exemplary embodiment of the nipper unit 25 depicted n FIG. 1 the lap-pressing element or member constitutes an additional nipper 9 which is advantageously pivotable, for example, about the axis of the intermittently rotatable feed cylinder or roll 7 appropriately driven by drive or drive means 65. Likewise forming part of the inventive combing machine 50 are a cleaning brush 60 comprising a brush roll or roller 11, and a suction shaft or tube 10 connected to a merely schematically illustrated vacuum or negative pressure source 40. The suction shaft or tube 10 possesses an intake port or opening 10*a* which is adjacent to the detaching pressure roll or roller 4. It can be convenient to provide only a part or portion of the circumference of the brush roll or roller 11 of the cleaning brush 60 with a brush segment 12 such that the latter cooperates solely with the circular-comb segment 2 and, accordingly, does not damage the detaching segment 3. It is here noted that the drive or drive means 65 can selectively rotate the intermittently rotatable feed cylinder or roll 7 prior to, subsequent to or both prior and subsequent to the detachment of fibers from the lap fed to the lower nipper 5.

Having now had the benefits of the foregoing discussion of the exemplary embodiment of the combing machine 50 depicted in FIG. 1, its mode of operation will now be described and is as follows:

As mentioned hereinbefore, the nipper unit 25 is closed when the circular-comb segment 2 passes beneath the front edge 5' of the lower or bottom nipper 5. The nipper unit 25 in this closed or rear end position presents to the circular-comb segment 2 a fiber tuft from the infed lap W.

The nipper unit 25 then opens after the circular-comb segment 2 has left this fiber tuft. The intermittently rotatable feed cylinder or roll 7 can now advance, by an adjustable amount, the lap W at the lower or bottom nipper 5. The additional nipper 9 is then lowered toward the lower or bottom nipper 5, as depicted in FIG. 1, in order to retain the lap W clamped against the lower or bottom nipper 5 during the following detaching operation. The lap clamping location at the lower or bottom nipper 5 is slightly behind or at the rear of the front edge 5' of the latter.

During further rotation of the circular-comb cylinder or roll 1, the fiber tuft then comes to lie, more or less in the depicted position of the circular-comb cylinder or roll 1, upon the arriving detaching segment 3, is then raised by the latter and clamped against the detaching pressure roll or roller 4. As the detaching segment 3 continues to move, the fibers clamped between the detaching segment 3 and the detaching pressure roll or roller 4 are then detached. The detached fibers are sucked into the suction means here shown as the suction shaft or tube 10. The detaching pressure roll or roller 4 can be rotated either by the rotary movement of the detaching segment 3 or by a suitable individual drive or drive means.

After detachment of the fibers the additional nipper 9 is lifted away from the lower or bottom nipper 5. The intermittently rotatable feed cylinder or roll 7 can then again advance, by an adjustable amount, the lap W at the lower or bottom nipper 5. This second lap advance or feed movement is optional if the lap W has been advanced already prior to the detaching operation.

Before the circular-comb segment 2 reappears beneath the lower or bottom nipper 5, the nipper unit 25 is closed, whereafter the combing cycle recommences.

The fibers extracted or removed by suction through the shaft or tube 10 are in the form of fiber clusters which by virtue of the combing-out operation have been freed from or rid of impurities, contamination and short fibers. The combing machine 50 actually operates as a staple sorting or grading machine. The fiber clusters obtained can be retransformed into a sliver, for example, by means of a card or carding machine.

The combing machine 50 is simple in construction and design and has relatively few moving parts or components. Accordingly, the combing machine 50 is not only economical to manufacture and therefore relatively inexpensive, but also can operate at high working speeds. Furthermore, a high output or productivity is also rendered possible in that, when the upper or top nipper 6 is lifted away from the lower or bottom nipper 5, there is provided a free space without additional combing elements, i.e. without the otherwise customary top comb, between the front edge 5' of the lower or bottom nipper 5 and the detaching pressure roll or roller 4. In this manner, a thicker lap W can be supplied to the combing machine 50.

In FIGS. 2 to 6 there are depicted different possible variants or exemplary embodiments of the combing machine 50 constructed according to the invention.

Throughout theses FIGS. 2 to 6 there have been generally used the same reference characters to denote the same or analogous components as in FIG. 1.

Figure 2:
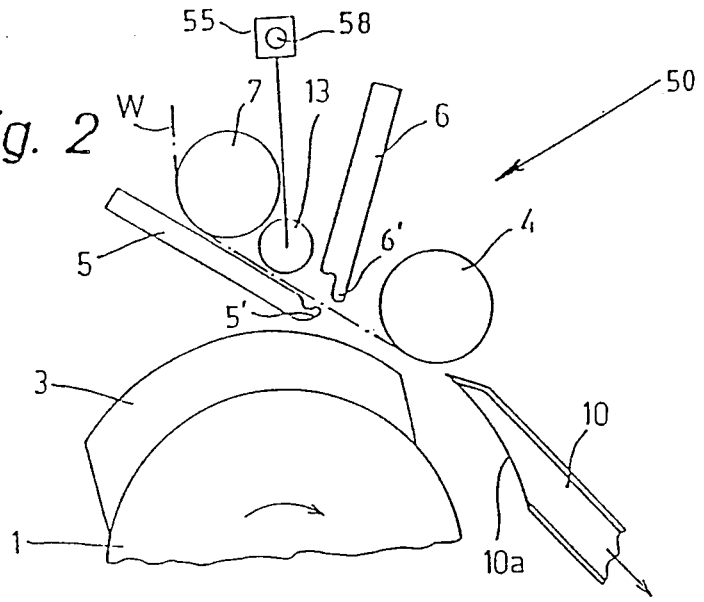
FIG. 2 shows a fragmentary side view, partially in section, of a first variant of a part of the combing machine depicted in FIG. 1.

In the first variant according to FIG. 2 the additional nipper 9 depicted in FIG. 1 has been omitted and replaced by a relatively small rotatable lap-pressing cylinder or roll 13 which is appropriately mounted at the lower or bottom nipper 5 and located as close as possible to the front edge 5' of the latter. This lap-pressing cylinder or roll 13, which continuously presses the lap W to be combed against the lower or bottom nipper 5, is driven each time, when the intermittently rotatable feed cylinder or roll 7 is rotated, by a suitable schematically illustrated drive or drive means 55 comprising a free wheel device 58.

Figure 3:
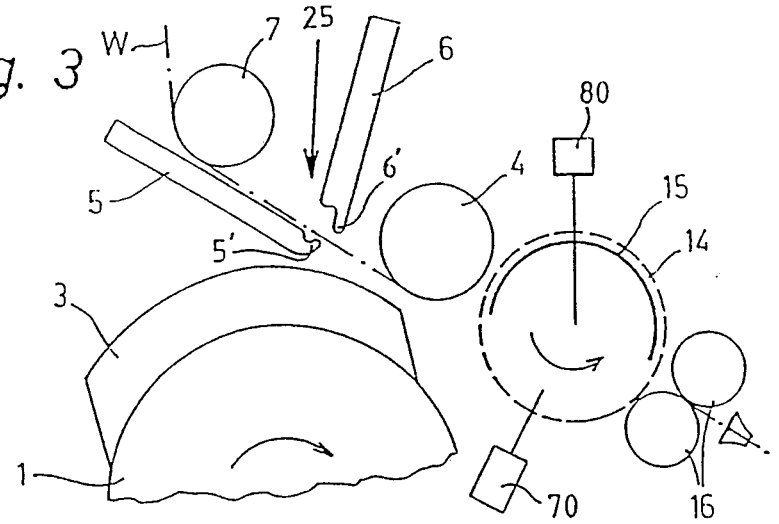
FIG. 3 shows a fragmentary side view, partially in section, of a second variant of a part of the combing machine depicted in FIG. 1.

In the second variant according to FIG. 3 the suction shaft or tube 10 depicted in FIG. 1 is omitted and replaced by a rotatable screening or sieve drum 14 which is adjacent to the detaching pressure roll or roller 4 and which sucks in, i.e., conveys by suction, the fibers detached by the detaching segment 3 and the detaching pressure roll or roller 4. This rotatable screening or sieve drum 14, the interior or interior space thereof being connected to a merely schematically illustrated vacuum or negative pressure source 70, possesses an air-pervious shell or jacket which is internally covered in an upper zone of its circumference by a stationary air-impervious shielding or shielding member 15. Consequently, the vacuum or negative pressure or underpressure is effective only in a lower zone of the shell circumference at which the extracted fibers are conveyed by the rotation of the screening or sieve drum 14 to a pair of pressure rollers 16 arranged downstream of the latter. The screening or sieve drum 14 is rotated by suitable and thus merely schematically shown drive means 80 either continuously, or by steps, or with a pilgrim step motion. If it is ensured by appropriate drive means that the fiber clusters, which are consecutively detached by the detaching segment 3 and the detaching pressure roll or roller 4, overlap to some extent at the screening or sieve drum 14, the combing machine variant depicted in FIG. 3 together with the pair of pressure rollers 16 renders possible that a sliver is directly obtained. However, it is also possible to individually or separately transport the fiber clusters at the screening or sieve drum 14 and to unite such fiber clusters to form a sliver only at the pair of pressure rollers 16, the latter being rotated with a pilgrim step motion.

Figure 4:
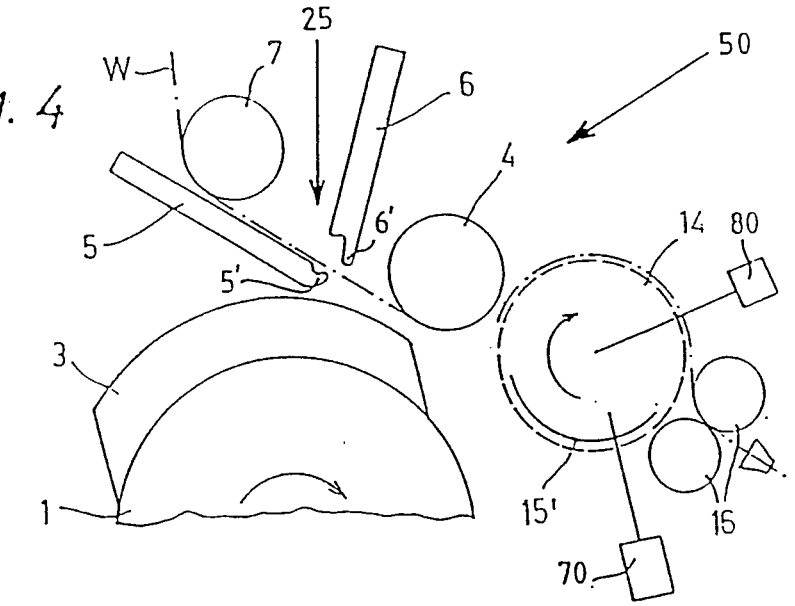
FIG. 4 shows a fragmentary side view, partially in section, of a third variant of a part of the combing machine depicted in FIG. 1.

The third variant according to FIG. 4 differs from the variant according to FIG. 3 only in that the screening or sieve drum 14 rotates in the opposite direction and that a stationary air-impervious shielding or shielding member 15' covers the air-pervious shell or jacket of the screening or sieve drum 14 internally in a lower zone or region of its circumference. The vacuum or negative pressure or underpressure provided by the vacuum source 70 is therefore effective only in an upper zone or region of the circumference of the screening or sieve drum 14 and the sucked-in, i.e., suction-conveyed, fibers are conveyed at this upper zone of the drum circumference to the pair of pressure rollers 16. In other respects, the operation is the same as for the second variant according to FIG. 3.

To simplify the illustration, no lap-pressing element or member to press the lap W against the lower or bottom nipper 5 is depicted in FIGS. 3 and 4. However, these variants are conveniently provided with either an additional nipper 9, as shown in FIG. 1, or a relatively small rotatable lap-pressing cylinder or roll 13, as shown in FIG. 2.

Figure 5:
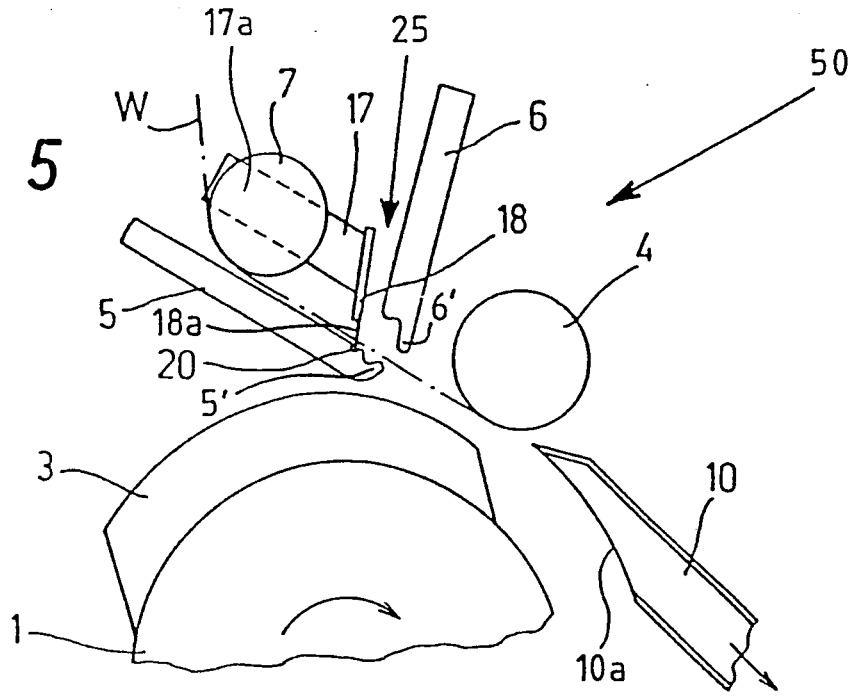
FIG. 5 shows a fragmentary side view, partially in section, of a fourth variant of a part of the combing machine depicted in FIG. 1.

On the other hand, in the fourth variant depicted in FIG. 5, the lap-pressing element or member is omitted. Instead, a top comb 18 having top comb needles or teeth 18*a* is disposed at movable supports 17 carried by the lower or bottom nipper 5 and movable relative thereto, such supports 17 being, for example, levers or lever members 17*a* which are pivotable about the axis of the intermittently rotatable feed cylinder or roll 7. In operation, the top comb 18 is kept lowered at the lower or bottom nipper 5 in the depicted position during fiber detachment, in order to comb out the trailing or rear ends of the fiber clusters detached from the lap W. The lower or bottom nipper 5 possesses immediately behind its front edge 5' a groove 20 which receives the free ends of the needles or teeth 18*a* of the top comb 18, so that the latter can extend fully through the lap W. However, while the lap w is being advanced by rotation of the intermittently rotatable feed cylinder or roll 7, the top comb 18 is lifted and thus disengaged from the lower or bottom nipper 5.

Figure 6:
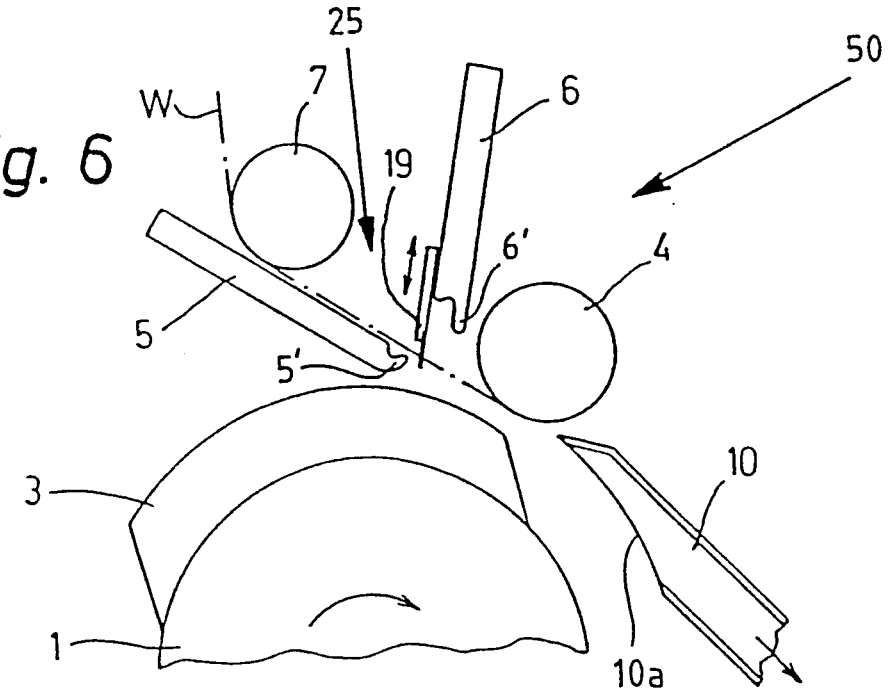
FIG. 6 shows a fragmentary side view, partially in section, of a fifth variant of a part of the combing machine depicted in FIG. 1.

When it is preferred to use a top comb 18 together with a lap-pressing element or member, it is possible to arrange, as shown in FIG. 6, a top comb 19 to be movable at the upper or top nipper 6. This top comb 19 is in the depicted lower position during fiber detachment in order to comb out the trailing or rear ends of the fiber clusters detached from the lap W. For the remainder of the time, the top comb 19 is upwardly withdrawn relative to the upper or top nipper 6. The lap-pressing element or member is not shown in FIG. 6. However, either the additional nipper 9 of the variant in FIG. 1 or the relatively small lap-pressing cylinder or roll 13 depicted in FIG. 2 can be provided.

Figure 1A:
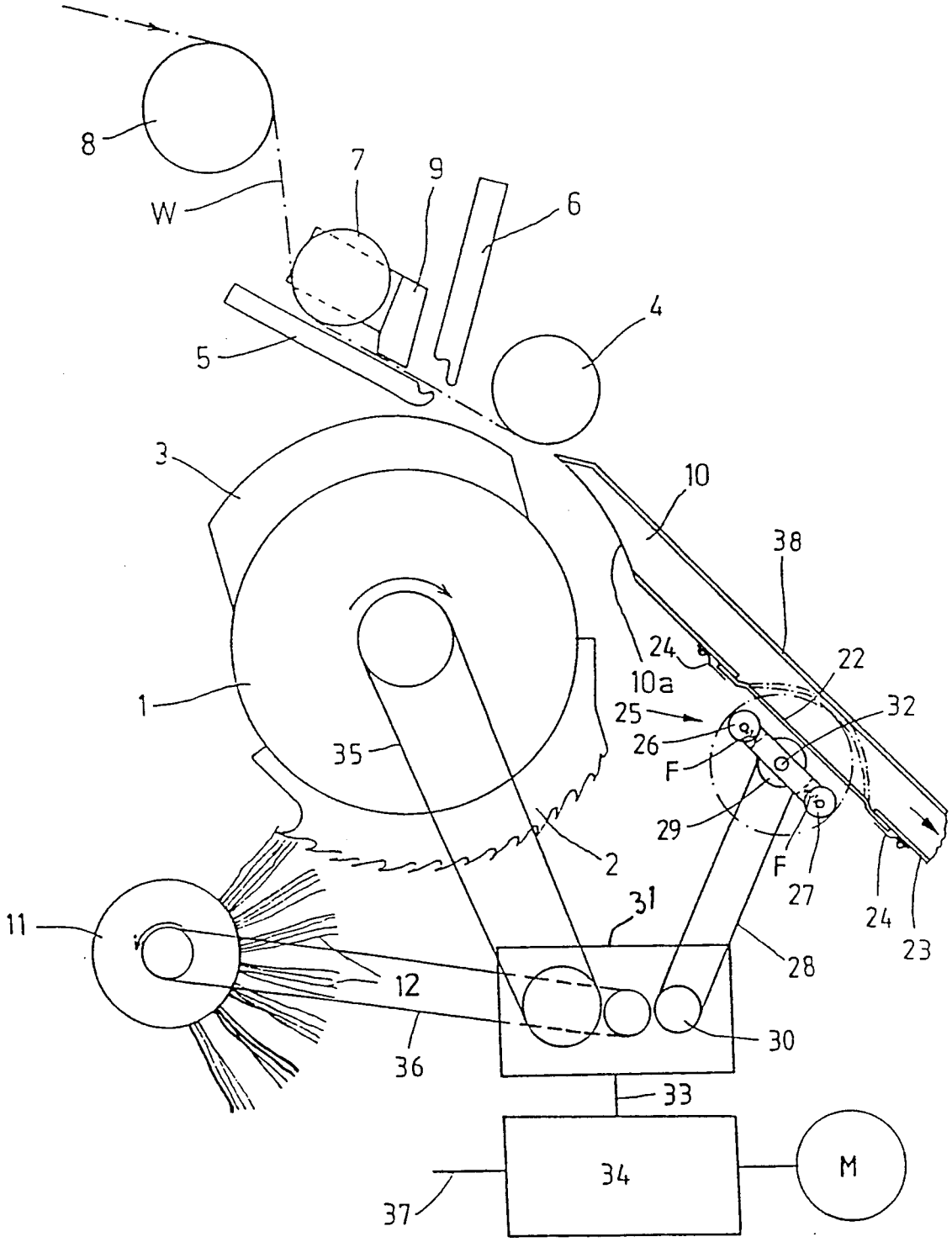
FIG. 1A shows a vertical side view of the essential parts of a variant of the combing machine which includes an element for closing the suction tube.

FIG. 1A shows an exemplary embodiment, in which an elastic rubber membrane 22 forms a portion of the lower wall 23 for the purpose of controlling the stream of suction air S at the suction shaft 10 and over its entire width. The rubber membrane 22 is fastened by means of clamping strips 24 fixed on the wall 23. A rotatable control cam 25, mounted at a fixed distance to the shaft 10, is disposed below the rubber membrane 22.

The control cam 25 has two rollers 26, 27, which are rotatably fixed on each end of the control cam 25. The control cam 25 is driven by a belt drive 28, for example, connecting a disk 29 with a drive wheel 30 driven by a gear 31. The disk 29 is connected, fixed against rotational displacement on the shaft 32, with the control cam 25.

The gear 31 is connected via a shaft 33 with a main gear 34 driven by a motor M. Additional drives are connected with the gear 31 by means of a belt drive 35 of the drive of the circular combing roller 1 as well as of a belt drive 36 of the drive of the brush roller 11. All three components, the circular combing roller 1, the brush roller 11 and the control cam 25 are thus drivingly coupled with each other via the gear 31. A further output shaft 37 has been indicated at the main gear 34, by means of which the nipper component 5, 6 and the elements cooperating with the nipper component are driven. The exact illustration of the layout of the drive has been omitted for reasons of clarity. Other transfer elements, such a chain drives or direct drives by means of toothed gears can be used instead of the belt drives 28, 35, 36.

In the position illustrated in FIG. 1A, the nipper component 5, 6 is open and the auxiliary nipper 9 is lowered towards the lower nipper 5, by means of which the fiber tuft, already combed by the circular combing roller 1, is clamped. The suction shaft 10 is open, because the rollers 26, 27 are located outside of the area of the rubber membrane 22. With continued turning of the circular combing roller 1, the fiber tuft comes to rest on the tear-off segment 3 and is lifted and pressed against the tear-off pressure cylinder 4 by it. Because of the continued movement of the tear-off segment 3, the fibers clamped between it and the tear-off pressure cylinder 4 are torn off and sucked into the still open suction shaft 10. Following the drawing off of the torn-off fibers and continued rotation of the circular combing roller 1, the roller 26 of the control cam 25 reaches the area of the rubber membrane 22 and, because of the elastic nature of the membrane 22, displaces it into the position indicated by dash-dotted lines. The suction shaft 10 is closed and fibers or other substances can now no longer be drawn off.

The drive of the circular combing roller 1 and the control cam 25 in connection with the drive of the nipper component 5, 6 are coordinated with each other in such a way that, in the closed position of the membrane 22 in the suction shaft 10 shown by dash-dotted lines, the combing process of the fiber tuft introduced by the nipper 5, 6 has already been completed and that the circular combing segment 2 with the combed short fibers, also called noils, just passes by the entry opening 10*a*. Because the control cam turns at half the rpm of the circular combing roller 1, there is sufficient time for the roller 26 to press the membrane 22 against the upper wall 38 of the suction shaft 10, so that the combing segment 2 can pass the opening 10*a* in its closed position and thus short fibers cannot enter the suction shaft 10. In the course of the next passage, the roller 27 comes to rest on the membrane 22. In order to lengthen the fastening point on the upper wall 38, the rollers 26, 27 may be fastened on the lever 42 of the control cam 22 under the tension of a suggested spring F.

Figure 7:
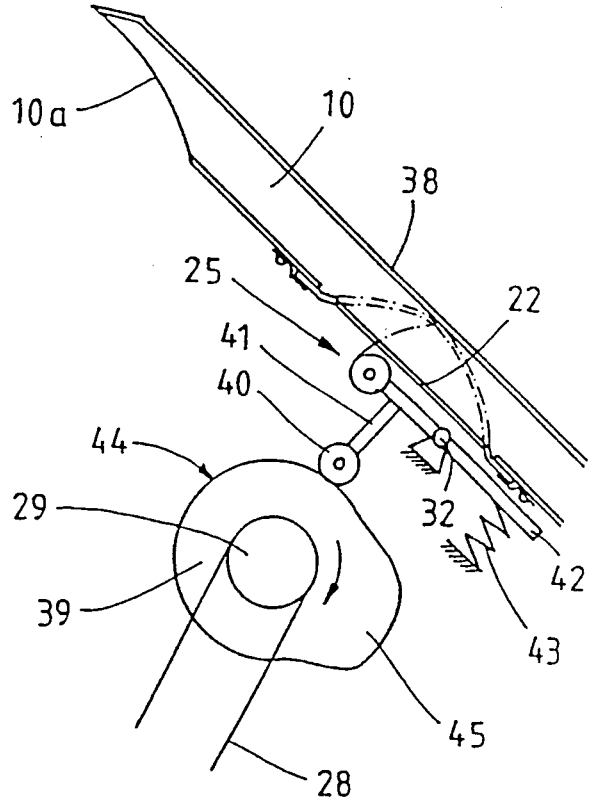
FIG. 7 shows a fragmentary side view of a variant of the closing element of the suction tube of FIG. 1A.

A further embodiment of the operation of the control cam is the control, shown in FIG. 7, via a cam disk 39 also driven by the gear 31. The control cam 25 is controlled via a roller 40 which rests on the exterior contour 44 of the cam disk 39. The roller 40 is connected via an arm 41 with the lever 42, seated pivotably around the rotation axis 32, and is maintained in contact with the exterior contour 44 by means of a spring 43 acting on the lever 42 on the opposite side of the rotation axis. The exterior contour 44 of the cam disk 39 is provided with a radial rise 45 over a set distance of its circumference. The cam disk 39 is controlled in such a way, or the rise 45 is disposed in such a way, that the membrane 22 takes up the position shown by dash-dotted lines, which closes the suction shaft 10 when the combing segment 2 passes the suction shaft opening 10*a*.

Figure 8:
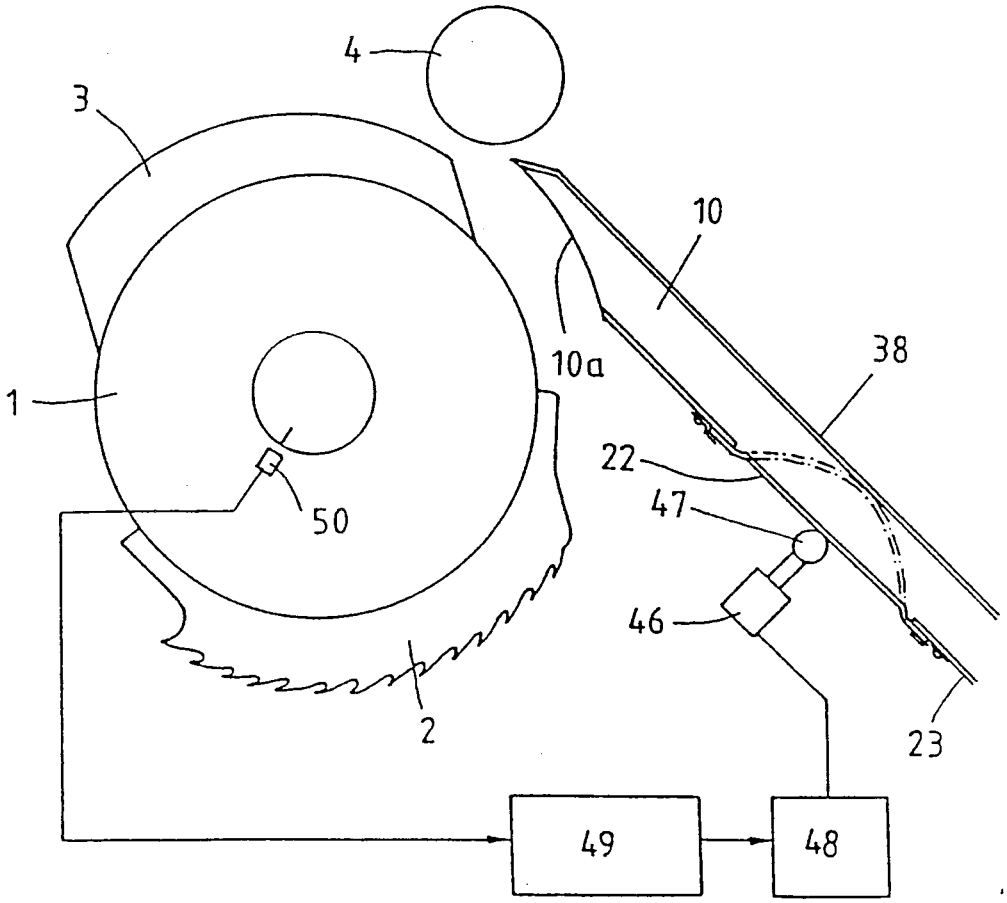
FIG. 8 shows a fragmentary side view of another variant of the closing element of the suction tube of FIG. 1A.

A further embodiment is shown in FIG. 8. In this case a rod 47, supported by two or more pneumatic valves 46 which are connected with each other, and disposed crosswise to the suction shaft, is displaced into the area of the membrane 22 for closing the suction shaft 10. The valves 46 are fed by a compressed air source 48 which is controlled by means of a control device 48. For the purpose of control, the rotational angle position of the circular combing roller 1 is sensed by means of a sensor 50, which transmits a signal for the valves 46 to the control device 49. In this way it is possible to close the suction shaft at exactly that moment when the combing roller 2 passes the opening 10*a*.

Finally, although the invention has been described with reference of particular means, materials and embodiments, it is to be understood that the invention is not limited to the particulars disclosed and extends to all equivalents within the scope of the claims.

What is claimed is:

1. A method of combing and conveying fibers comprising the steps of:

a) opening a suction tube;

b) tearing off fibers from a fiber tuft;

c) drawing off torn off fibers into said suction tube;

d) combing the fibers to remove noils;

e) closing said suction tube;

f) removing the noils from the comb; and g) opening said suction tube.

2. The method of claim 1, wherein the noils are removed by a cleaning brush.

3. The method of claim 1, wherein the noils are coveyed past said suction tube while said suction tube is closed.

4. The method of claim 3, wherein the fibers are torn off by a detaching segment and the fibers are combed by a circular-comb segment, said detaching segment and said circular-comb segment being mounted on a rotatable roll.

5. The method of claim 4, wherein said suction tube is opened and closed in association with rotation of said rotatable roll.

6. A combing machine, comprising:

a rotatable circular-comb cylinder having a predetermined axis of rotation;

said rotatable circular-comb cylinder carrying at least one circular-comb segment and at least one detaching segment, said at least one detaching segment detaching combed-out fibers of a lap to be combed; and suction means for conveying by suction the combed-out fibers detached by said at least one detaching segment and said detaching pressure roll, and means for closing said suction means.

7. The combing machine according to claim 6, wherein said suction means includes a suction shaft, and said means for closing includes a flexible membrane for moving into closing said suction shaft.

8. The combing machine according to claim 7, wherein said flexible membrane is formed from an elastic material.

9. The combing machine according to claim 8, wherein said flexible membrane is formed from rubber.

10. The combing machine according to claim 7, wherein said means for closing includes a rotatable cam contacting said flexible membrane and moving said flexible membrane into said suction shaft.

11. The combing machine according to claim 10, wherein said circular-comb cylinder is rotated by a drive means, said drive means also rotating said rotatable cam.

12. The combing machine according to claim 11, comprising a cleaning roll for cleaning noils from said circular-comb segment, said drive means including a central gear, said circular-comb cylinder, said rotatable cam, and said cleaning roll being driven by said control gear.

13. The combing machine according to claim 7, wherein said closing means includes a pivotable cam contacting said flexible membrane and moving said flexible membrane into said suction shaft.

14. The combing machine according to claim 13, wherein said pivotal cam is moved in response to a rotatable cam.

15. The combing machine according to claim 14, wherein said pivotal cam includes a spring to bias said pivotal cam into contact with said rotatable cam.

16. The combing machine according to claim 7, wherein said closing means includes a rod which contacting said flexible membrane and moving said flexible membrane into said suction shaft.

17. The combing machine according to claim 16, wherein said rod is moved by compressed air, and comprising at least one pneumatic valve controlling the flow of said compressed air.

18. The combing machine according to claim 17, comprising a sensor for sensing the position of said circular-comb cylinder, said sensor controlling at position of said at least one pneumatic valve.

* * * * *